United States Patent [19]

Sonoda et al.

[11] Patent Number: 4,729,349

[45] Date of Patent: Mar. 8, 1988

[54] OIL SUPPLY SYSTEM FOR A VALVE OPERATING MECHANISM IN INTERNAL COMBUSTION ENGINES

[75] Inventors: Toshinari Sonoda; Toshiaki Hiro; Toshihiko Matsubara, all of Saitama, Japan

[73] Assignee: Honda Giken Kogyo Kabushiki Kaisha, Tokyo, Japan

[21] Appl. No.: 898,953

[22] Filed: Aug. 21, 1986

[30] Foreign Application Priority Data

| | | | |
|---|---|---|---|
| Aug. 21, 1985 | [JP] | Japan | 60-183603 |
| Aug. 30, 1985 | [JP] | Japan | 60-191148 |
| Oct. 21, 1985 | [JP] | Japan | 60-160880[U] |
| Oct. 21, 1985 | [JP] | Japan | 60-160878[U] |

[51] Int. Cl.[4] ..... F01M 1/06

[52] U.S. Cl. ..... 123/90.34; 123/196 R; 184/6.9

[58] Field of Search ..... 123/90.33, 90.34, 90.23, 123/90.35, 196 R; 184/6.9

[56] References Cited

U.S. PATENT DOCUMENTS

| | | | |
|---|---|---|---|
| 1,580,082 | 4/1926 | Ybarra | 123/90.34 |
| 4,512,298 | 4/1985 | Hayashi | 123/90.33 |
| 4,559,018 | 11/1982 | Wade | 123/90.34 |

FOREIGN PATENT DOCUMENTS

| | | | |
|---|---|---|---|
| 575263 | 5/1959 | Canada | 123/90.33 |
| 5416 | 1/1983 | Japan | 123/90.33 |

*Primary Examiner*—E. Rollins Cross

*Attorney, Agent, or Firm*—Lyon & Lyon

[57] ABSTRACT

Oil is supplied from an oil pump as working oil to hydraulic lash adjusters and also as lubricating oil to journals and cams of a camshaft. The oil passage system includes a first supply passage connected to the oil pump, a second supply passage connected between the first supply passage and a first distribution passage coupled to a group of hydraulic lash adjusters, a joint passage connected to the first distribution passage, and a second distribution passage coupled to the joint passage and connected to another group of hydraulic lash adjusters. The second distribution passage is connected by air vent passages to a lubricating oil passage which supplies the camshaft with the lubricating oil. The joint passage is connected to one of the camshaft journals by a relief passage having a relief valve.

13 Claims, 10 Drawing Figures

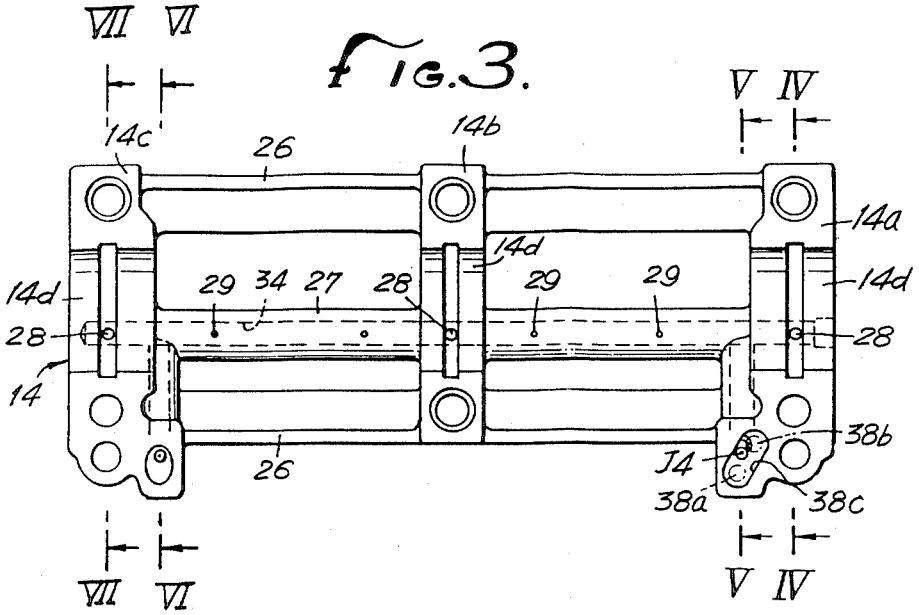
FIG. 3.
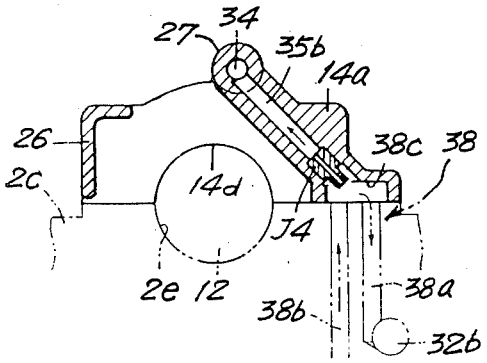
FIG. 5.
FIG. 4.
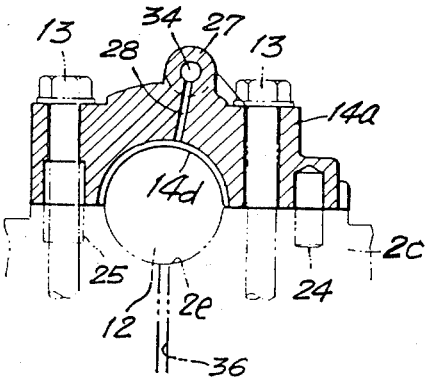

FIG. 6.
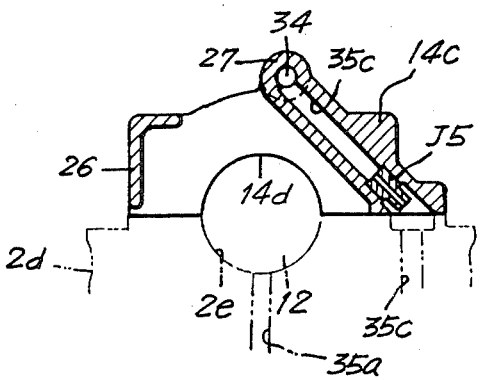
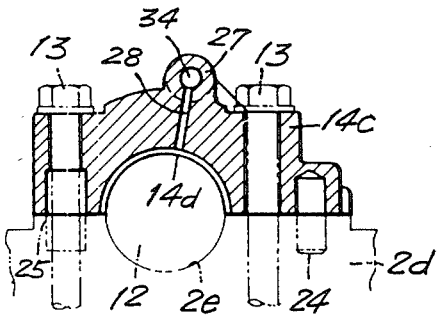
FIG. 7.

OIL SUPPLY SYSTEM FOR A VALVE OPERATING MECHANISM IN INTERNAL COMBUSTION ENGINES

The present invention relates to a system for supplying oil to the camshaft and hydraulic lash adjusters of a valve operating mechanism in an internal combustion engine.

One known valve operating mechanism having a number of hydraulic lash adjusters is disclosed in Japanese Laid-Open Patent Publication No. 60(1985)35106. Each of the hydraulic lash adjusters comprises a free ball valve including a plunger which will be depressed to a certain extent under an applied load before the plunger can produce a bearing force to support a cam follower held in slidable engagement with a camshaft. This depression of the plunger is utilized to absorb fluctuations of the axis of the camshaft for thereby preventing an intake or exhaust valve from being jerked off the valve seat. The plunger is required to be quickly raised back when the intake or exhaust valve has been closed in order to eliminate any gap between the cam follower and the upper end of the valve stem of the intake or exhaust valve. It has been customary to supply working oil under high pressure into an oil chamber in the hydraulic lash adjusters through an orifice so that when the free ball valve is opened, high-pressure oil will be introduced into a pressure chamber in the hydraulic lash adjusters to lift the plunger. However, it has been difficult to apply appropriate oil pressure in the oil chamber at all times over a wide range of engine speeds.

Such difficulty manifests itself particularly where the hydraulic lash adjusters are divided into first and second groups and working oil is supplied from a common oil source such as an oil pump operated by the engine to these different groups of hydraulic lash adjusters. If the oil pressure applied to the hydraulic lash adjusters were lower than a suitable pressure level, then the plunger would fail to be lifted back as quickly as required. If the oil pressure applied to the hydraulic lash adjusters were higher than the suitable pressure level, then the plunger would be raised excessively against the force of the valve spring, making the intake or exhaust valve fail to be properly seated on its valve seat.

The valve operating mechanism is supplied with working oil through an oil supply system including a supply passage for supplying the oil from the oil pump, a distribution passage for feeding the oil from the supply passage to the hydraulic lash adjusters, and a relief passage connected to the distribution passage and having a relief valve which can be opened when the oil pressure in the distribution passage is increased beyond a prescribed pressure level. The relief valve serves to keep the oil pressure in the distribution passage constant irrespective of engine speeds and changes in temperature, for thereby permitting the hydraulic lash adjusters to operate stably.

The oil pump generally has its capacity selected to apply a predetermined oil pressure in the distribution passage even when it pumps a minimum amount of oil. Therefore, when the engine operates at a higher speed to discharge a larger amount of oil from the oil pump, a great amount of excessive oil flows from the distribution passage into the relief passage. Since the relief valve simply opens into an oil pan of the engine, such an excessive amount of discharged oil simply returns from the distribution passage to the oil pan without acting on the hydraulic lash adjusters. This is quite wasteful inasmuch as the excessive oil that flows back to the oil pan may amount to many times that which is actually supplied to the hydraulic lash adjusters when the engine speed is high.

When the engine is shut off, the oil pump is also shut off, and the oil in the supply passage flows down back to the oil pump. At this time, the oil tends to be siphoned from the distribution passage back to the oil pump via the supply passage. With the distribution passage thus emptied, the hydraulic lash adjusters cannot immediately be supplied with working oil when the engine is restarted.

SUMMARY OF THE INVENTION

It is an object of the present invention to provide an oil supply system for a valve operating system of an internal combustion engine, the oil supply system being capable of continuously supplying oil under proper pressure from a single oil pressure source to oil chambers in groups of hydraulic lash adjusters at all times over a wide range of engine operation speeds.

Another object of the present invention is to provide an oil supply system for a valve operating mechanism of an internal combustion engine, the oil supply system having a relief valve for allowing constant oil pressure to be applied to hydraulic lash adjusters, the relief valve being detachably mounted in a cylinder head.

Still another object of the present invention is to provide an oil supply system for a valve operating mechanism of an internal combustion engine, the oil supply system having air vent passages for preventing working oil from being siphoned from distribution passages back to an oil pressure source, so that the working oil can be maintained in the distribution passages in readiness for an engine restart.

A still further object of the present invention is to provide an oil supply system for a valve operating mechanism of an internal combustion engine, the oil supply system having a relief passage communicating with a journal of a camshaft for utilizing oil from the relief passage for camshaft lubrication, thus reducing wasteful oil consumption and the size of an oil pump used.

According to the present invention, there is provided a system for supplying oil to a camshaft and hydraulic lash adjusters of a valve operating mechanism in an internal combustion engine, the system including a supply passage for supplying oil under pressure, a distribution passage connected to the supply passage for distributing oil from the supply passage as working oil to the hydraulic lash adjusters, and a lubricating oil passage connected to the distribution passage for supplying oil from the distribution passage as lubricating oil to lubricate journals and cams of the camshaft. The oil supplied from the single oil pump is therefore effectively utilized as working oil in the hydraulic lash adjusters and also as lubricating oil for the camshaft.

A relief passage communicates between the distribution passage and one of the journals and has a relief valve openable when the pressure of oil in the distribution passage rises beyond a predetermined level. The relief valve thus allows oil under proper pressure to be supplied to the hydraulic lash adjusters at all times. The relief passage is defined in the cylinder head of the engine, and the relief valve is detachably mounted in the cylinder head. The detachable relief valve can easily be serviced. An oil check passage system is connected to the distribution passage for preventing oil from flowing from the distribution passage back to the supply passage. The lubricating oil passage has a plurality of oil outlet holes opening toward the cams of the camshaft, and an air vent passage is interconnected between the oil check passage system and the lubricating oil passage. Another air vent passage is interconnected between the distribution passage and the lubricating oil passage, and still another air vent passage is interconnected between the supply passage and one of the journals of the camshaft. Each of the air vent passages has an orifice. The distribution passage includes first and second distribution passages which extend substantially parallel to each other, and the supply passage comprises first and second supply passages, the first supply passage being connected to an oil pump and the second supply passage to the first distribution passage. The second supply passage extends obliquely downwardly away from the first supply passage.

When the engine is stopped, oil in the second supply passage and hence the first and second distribution passages is prevented by the inclined second supply passage from flowing back via the first supply passage into the oil pump. Furthermore, air drawn through the oil outlet holes of the lubricating oil passage into the air vent passages prevents oil from being siphoned from the distribution passages and the second supply passage back to the oil pump.

The above and other objects, features and advantages of the present invention will become more apparent from the following description when taken in conjunction with the accompanying drawings in which a preferred embodiment of the present invention is shown by way of illustrative example.

BRIEF DESCRIPTION OF THE DRAWINGS

FIG. 3 is a bottom view of a camshaft holder assembly in the engine shown in FIG. 1;

FIG. 4 is a cross-sectional view taken along line IV—IV of FIG. 3;

FIG. 5 is a cross-sectional view taken along line V—V of FIG. 3;

FIG. 6 is a cross-sectional view taken along line VI—VI of FIG. 3;

FIG. 7 is a cross-sectional view taken along line VII—VII of FIG. 3;

DESCRIPTION OF THE PREFERRED EMBODIMENT

Figure 1:
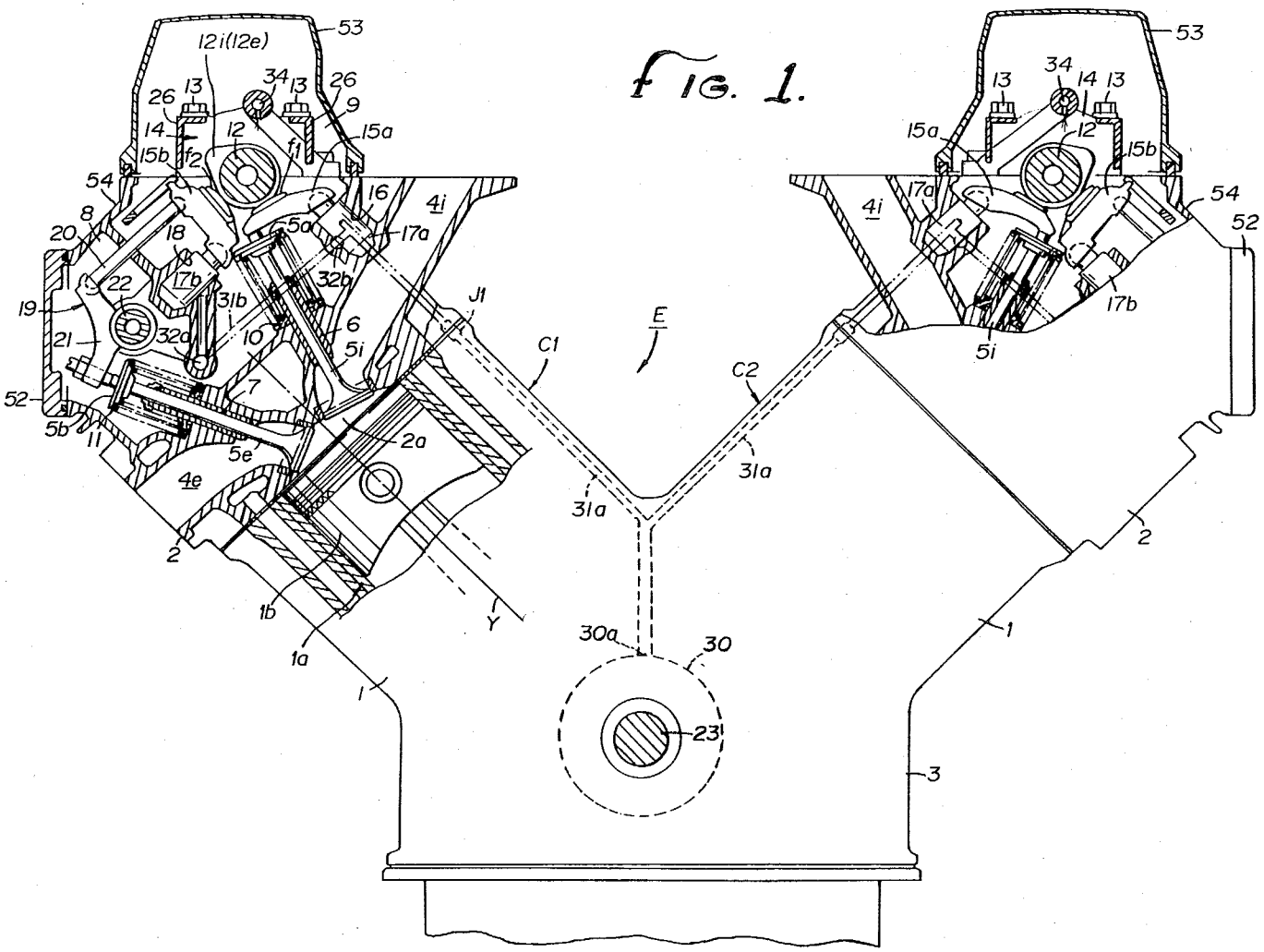
FIG. 1 is a front elevational view, partly in vertical cross section, of an internal combustion engine incorporating an oil supply system according to the present invention.

FIG. 1 shows a V-shaped multicylinder internal combustion engine E having a pair of angularly spaced cylinder blocks 1 including respective cylinder banks C1, C2 and inclined away from each other at equal angles from the vertical axis of the engine 1. The cylinder blocks 1 have respective lower ends interconnected by a common crankcase 3. Cylinder heads 2 are fastened respectively to the upper ends of the cylinder blocks 1.

Since the cylinder blocks 1 and the respective cylinder heads 2 are symmetrically shaped, only the cylinder block 1 and the cylinder head 2 shown on the lefthand side in FIG. 1 will be described in detail.

The cylinder block 1 has an array of cylinders 1*a* (only one shown) spaced in a direction normal to the sheet of FIG. 1 and accommodating respective pistons 1*b* (only one shown) slidably therein. The cylinder head 2 has an array of combustion chambers 2*a* (only one shown) opening downwardly in communication with the cylinders 1*a*, respectively. The cylinder head 2 also includes intake and exhaust ports 4*i*, 4*e* opening into each of the combustion chambers 2*a*. The intake and exhaust ports 4*i*, 4*e* can be opened and closed by intake and exhaust valves 5*i*, 5*e*, respectively, slidably supported by valve guides 6, 7 in the cylinder head 2. The intake and exhaust valves 4*i*, 4*e*, are inclined to the axis Y of the cylinder 1*a* so that the upper ends of the valves 4*i*, 4*e* are widely spaced from each other. The intake valves 5*i* on the cylinder banks C1, C2 are positioned closer to the V-shaped valley or space defined between the cylinder banks C1, C2 than the exhaust valves 5*e*.

The intake and exhaust valves 5*i*, 5*e* are operated by a valve operating mechanism 9 disposed in a chamber 8 defined in the cylinder head 2. The valve stems of the intake and exhaust valves 5*i*, 5*e* extend upwardly into the chamber 8. Valve springs 10, 11 are disposed around the valve stems and held under compression between retainers 5*a*, 5*b* and cylinder head members for normally urging the intake and exhaust valves 5*i*, 5*e* in a direction to close the intake and exhaust ports 4*i*, 4*e*. A single camshaft 12 is disposed above the intake valve 5*i* and rotatably supported by the cylinder head 2 and a camshaft holder assembly 14 is fastened thereto by bolts 13. The camshaft 12 has a plurality of cams 12*i*, 12*e* for operating the intake and exhaust valves 5*i*, 5*e*. First and second cam followers 15*a*, 15*b* are disposed underneath the camshaft 12 in a substantially V-shaped configuration and have respective slipper surfaces f1, f2 held in sliding contact with the cams 12*i*, 12*e*, respectively, at their lower portions.

The first cam follower 15*a* has an upper end angularly movably supported by a first hydraulic lash adjuster 17*a* mounted in a hole 16 defined in the cylinder head 2. The lower end of the first cam follower 15*a* is held against the upper end of the valve stem of the intake valve 5*i*.

The second cam follower 15*b* has a lower end angularly movably supported by a second hydraulic lash adjuster 17*b* mounted in a hole 18 defined in the cylinder head 2. The upper end of the second cam follower 15*b* acts on the upper end of the valve stem of the exhaust valve 5*e* through an interlink mechanism 19.

The interlink mechanism 19 comprises a pusher rod 20 having one end engaging the upper end of the second cam follower 15*b*, and a bellcrank-shaped rocker arm 21 having one end engaging the opposite end of the pusher rod 20 and the other end engaging the upper end of the valve stem of the exhaust valve 5*e*. The rocker arm 21 is angularly movably supported by a rocker shaft 22 in the cylinder head 3.

Figure 2:
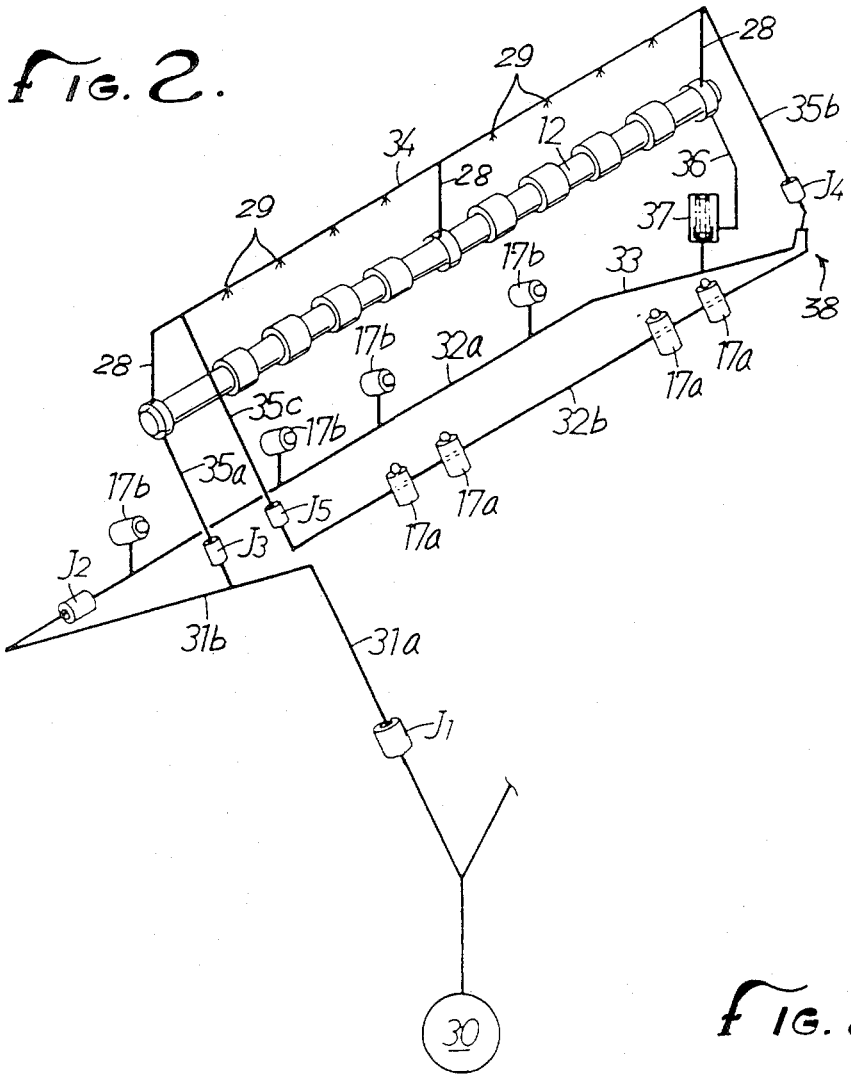
FIG. 2 is a schematic perspective view of the oil supply system of the present invention.

As illustrated in FIG. 2, there are as many first hydraulic lash adjusters 17*a* as the number of the intake valves 5*i*, and there are as many second hydraulic lash adjusters 17*b* as the number of the exhaust valves 5*e*. The first and second hydraulic lash adjusters 17*a*, 17*b* are arrayed at spaced horizontal intervals in alignment with the cylinders 1*a* of the cylinder banks C1, C2.

During operation of the engine E, the camshafts 12 in the cylinder banks C1, C2 are synchronously operated by a common crankshaft 23 through suitable synchronous transmission mechanisms (not shown).

The camshaft 12 extends horizontally along the array of cylinders 1*a*. As shown in FIGS. 3 through 7, the camshaft holder assembly 14 which supports the camshaft 12 is composed of a plurality of camshaft holders 14*a*, 14*b*, 14*c* spaced along the camshaft 12 and having respective semicircular bearing surfaces 14*d* facing downwardly. The cylinder head 2 has a plurality of bearing bases 2*c*, 2*d* spaced along the camshaft 12 in vertical alignment with the camshaft holders 14*a* through 14*c*, respectively, and having respective semicircular bearing surfaces 2*e* facing upwardly. The camshaft holders 14*a*–14*c* are fastened by the bolts 13 to the bearing bases 2*c*, 2*d* with the camshaft 12 being rotatably supported on the bearing surfaces 14*d*, 2*e*. As shown in FIGS. 4 and 6, the outermost camshaft holders 14*a*, 14*c* and the outermost bearing bases 2*c*, 2*d* are positioned relative to each other by means of positioning pins 24 and positioning collars 25.

As shown in FIGS. 1 and 3, the camshaft holders 14*a*–14*c* are interconnected by a pair of cross members 26 of L-shaped cross section which are joined to the lateral ends of the camshaft holders 14*a*–14*c*, and also interconnected by a tubular cross member 27 joined to the central portions of the camshaft holders 14*a*–14*c*. The tubular cross member 27 has a lubricating oil passage 34 defined axially therethrough. The camshaft holders 14*a*–14*c* have oil supply holes 28 defined respectively therein and extending from the lubricating oil passage 34 to the bearing surfaces 14*d*. The tubular cross member 27 also has a plurality of oil outlet holes 29 defined radially therein in communication with the lubricating oil passage 34 and opening into the chamber 8.

As shown in FIGS. 1 and 2, an oil pump 30 actuatable by the crankshaft 23 is disposed in the crankcase 3 and has an oil outlet 30*a* connected to a pair of first supply passages 31*a* defined in the respective cylinder blocks 1 and extending obliquely upwardly along the cylinder axes Y. Since the first supply passages 31*a* and supply passage systems connected thereto in the cylinder heads 2 are symmetrical in configuration, only the supply passage system in one of the cylinder heads 2 (which is shown on the lefthand side of FIG. 1) will be described in detail. The first supply passage 31*a* is connected to a second supply passage 31*b* defined in the cylinder head 2 and extending obliquely downwardly away from the upper end of the first supply passage 31*a*.

Figure 2A:
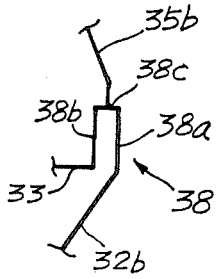
FIG. 2A is an enlarged schematic perspective view of an oil check passage system.

The cylinder head 2 has defined therein a first horizontal distribution passage 32*a* connected to oil inlets of the second hydraulic lash adjusters 17*b* and having an upstream end (closer to the pump 30) connected to the lower end of the second supply passage 31*b* a second horizontal distribution passage 32*b* extending parallel to the first horizontal distribution passage 32*a* and connected to oil inlets of the first hydraulic lash adjusters 17*a*, and a joint passage 33 interconnecting the downstream end of the first distribution passage 32*a* and the upstream end of the second distribution passage 32*b* through an oil check passage system 38. As shown in FIGS. 2A and 5, the oil check passage system 38 includes a first oil passage 38*a* defined in the bearing base 2*c* and extending upwardly from the upstream end of the second distribution passage 32*b*, a second oil passage 38*b* defined in the bearing base 2*c* parallel to the first oil passage 38*a* and extending upwardly from the downstream end of the joint passage 33, and a recess 38*c* defined in the camshaft holder 14*a* and communicating between the first and second oil passages 38*a*, 38*b*. The recess 38*c* is formed at the same time that the camshaft holder 14*a* is die-cast, and may be defined in the bearing base 2*c*.

The second distribution passage 32*b* lies higher than the first distribution passage 32*a*, but lower than the upper end of the first supply passage 31*a*.

As shown in FIG. 6, the bearing base 2*d* has a first air vent passage 35*a* extending from the second supply passage 31*b* to the bearing surface 2*e*. The camshaft holder 14*a* has a second air vent passage 35*b* (FIG. 5) extending from the recess 38*c* of the oil check passage system 38 to the lubricating oil passage 34 in the tubular cross member 27. The bearing base 2*d* and the camshaft holder 14*c* jointly have a third air vent passage 35*c* (FIG. 6) extending from the downstream end of the second distribution passage 32*b* to the lubricating oil passage 34. A relief passage 36 extends from the joint passage 33 to the bearing surface 2*e* of the bearing base 2*c* (FIG. 4).

The first supply passage 31*a* has a first orifice J1, and the first distribution passage 32*a* has a second orifice J2. The first through third air vent passages 35*a*, 35*b*, 35*c* have third, fourth, fifth orifices J3, J4, J5, respectively. The relief passage 36 has a relief valve 37 serving as a pressure regulator valve which can be opened when the oil pressure in the first distribution passage 32*a* or the second distribution passage 32*b* exceeds a predetermined level. The second orifice J2 has an orifice diameter equal to or smaller than that of the first orifice J1, and the third orifice J3 has an orifice diameter smaller than that of the second orifice J2.

Figure 8:
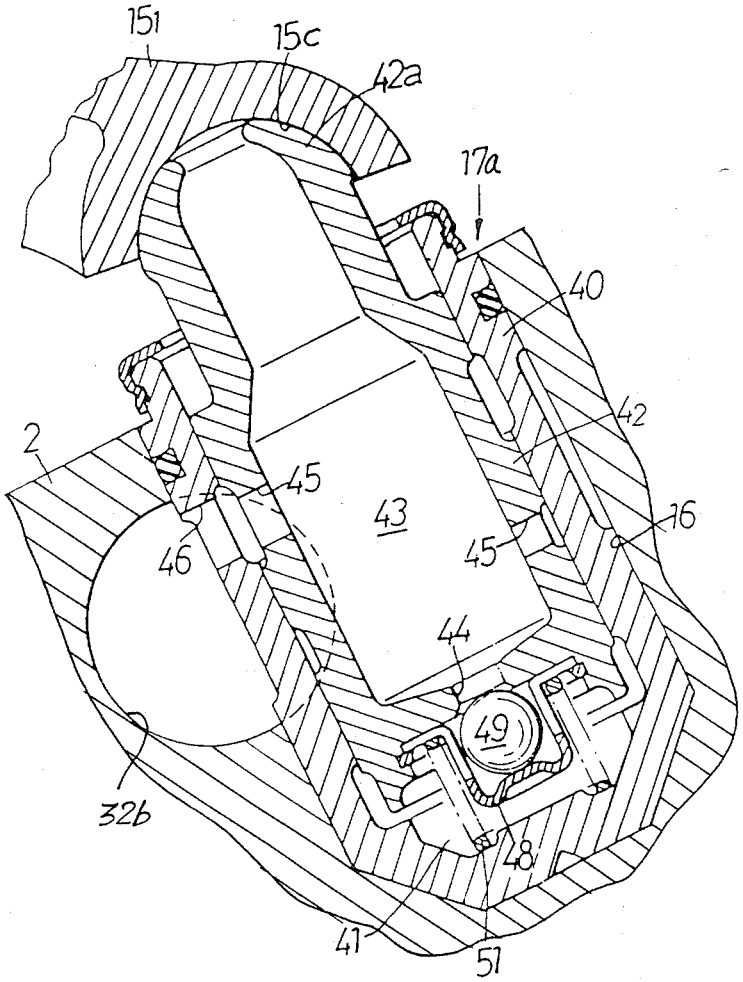
FIG. 8 is an enlarged vertical cross-sectional view of an hydraulic lash adjuster.

The first and second hydraulic lash adjusters 17*a*, 17*b* are identical in construction, and hence the first hydraulic lash adjuster 17*a* will be described below with reference to FIG. 8.

The hydraulic lash adjuster 17*a* comprises a bottomed cylinder 40 disposed in the hole 16, and a plunger 42 slidably fitted in the bottomed cylinder 40 and defining a pressure chamber 41 in the cylinder 40. The plunger 42 has an outer hemispherical end 42*a* engaging in a hemispherical cavity 15*c* defined in the upper end of the cam follower 15*a*. The plunger 42 has an oil chamber 43 defined therein and a valve hole 44 which provides fluid communication between the pressure chamber 41 and the oil chamber 43. The oil chamber 43 communicates with the second distribution passage 32*b* through an oil hole 45 defined in a side wall of the plunger 42 and an oil hole 46 defined in a side wall of the cylinder 40. The oil chamber 43 is always filled with oil fed from the second distribution passage 32*b*.

A hat-shaped valve cage 48 is attached to the lower end of the plunger 42 and accommodates therein a free ball valve 49 which serves as a check valve for opening and closing the valve hole 44. The free ball valve 49 is movable in a stroke which is limited by the valve cage 48. The free ball valve 49 opens the valve hole 44 when the oil pressure in the pressure chamber 41 is reduced, and closes the valve hole 44 when the oil pressure in the pressure chamber 41 is increased. A compression coil spring 51 is housed in the pressure chamber 41 for normally urging the plunger 42 in a direction to move upwardly out of the cylinder 40.

When the plunger 42 is subjected to a load by the cam follower 15*a*, a small amount of oil flows from the pressure chamber 41 through the valve hole 44 into the oil chamber 43 to allow the plunger 42 to be depressed to a certain extent. Thereafter, the free ball 49 closes the valve hole 44 to develop an oil pressure in the pressure chamber 41 for enabling the plunger 42 to produce a bearing force to support the upper end of the cam follower 15*a*. When the plunger 42 is released of the load from the cam follower 15*a*, the oil pressure in the pressure chamber 41 is lowered to open the free ball valve 49. The plunger 42 is now lifted under the resiliency of the spring 51 and the pressure of oil supplied from the oil chamber 43 via the valve hole 44 into the pressure chamber 41, quickly making up for the previous depression stroke to prevent any gap from being created between the upper end of the valve stem of the intake valve 5*i* and the lower end of the cam follower 15*a*.

Figure 9:
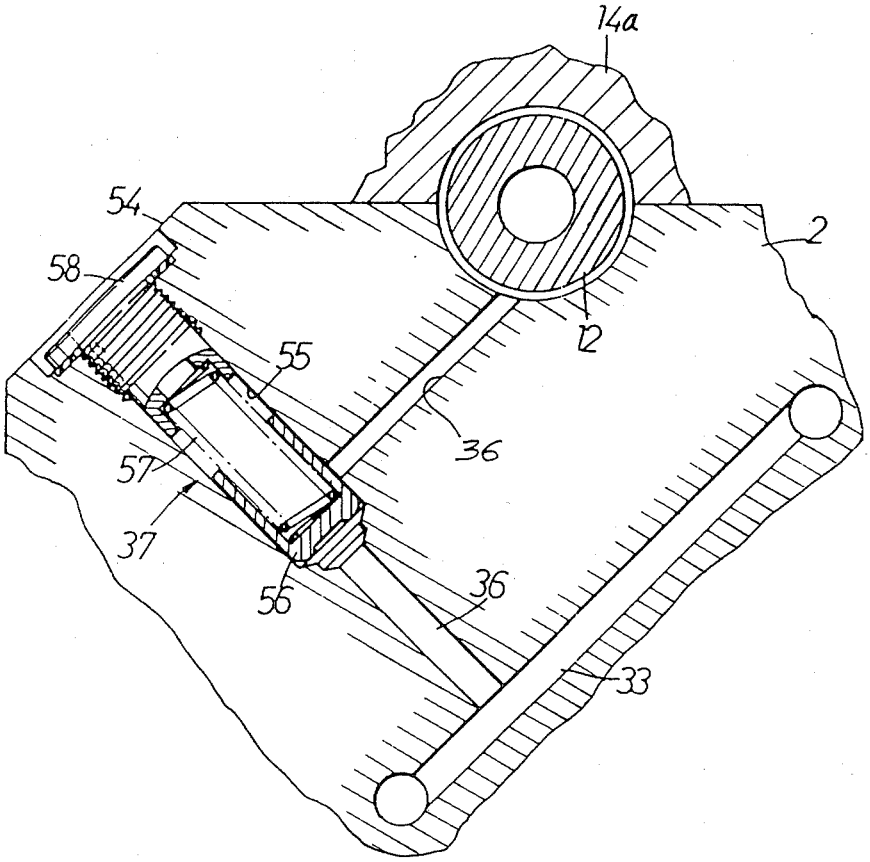
FIG. 9 is a vertical cross-sectional view of a relief valve and surrounding parts.

As shown in FIG. 1, a head cover 52 is attached to the cylinder head 2 close to the rocker shaft 22, and the camshaft holder assembly 14 is covered with a head cover 53 attached to the cylinder head 2, with a central exposed surface 54 of the cylinder head 2 being left between the head covers 52, 53. As illustrated in FIG. 9, the cylinder head 2 has a cylindrical valve housing recess 55 defined therein and opening at the central exposed surface 54. The relief valve 37 is fitted in the valve housing recess 55. The valve housing recess 55 has a bottom communicating with a portion of the relief passage 36 which lies upstream of the relief valve 37 and a side communicating with a portion of the relief passage 36 which lies downstream of the relief valve 37. The relief valve 37 comprises a piston-like valve body 56 slidably fitted in the valve housing recess 55 and a compression coil spring 57 disposed in the valve housing recess 55 for normally urging the valve body 56, under a constant force, into a closed position to cut off fluid communication through the relief passage 36. The compression coil spring 57 is supported at one end by a plug 58 removably and hermetically threaded in the open end of the valve housing recess 55. When the oil pressure in the joint passage 33 exceeds a pressure level established by the set load of the spring 57, the valve body 56 is slidably moved against the resilient force of the spring 57 to open the relief passage 36.

Operation of the oil supply system thus constructed is as follows: While the engine E is in operation, the camshafts 12 in the cylinder banks C1, C2 are rotated about their own axes by the crankshaft 23 via the non-illustrated synchronous transmission devices. When the piston 1*b* starts moving in the intake stroke, the first cam follower 15*a* is swung downwardly by the cam 12*i* about the first hydraulic lash adjuster 17*a* to open the intake valve 5*i*, which then allows an air-fuel mixture to be introduced from the intake port 4*i* into the combustion chamber 2*a*. When the piston 1*b* starts to move in the exhaust stroke, the second cam follower 15*b* is swung downwardly by the cam 12*e* about the second hydraulic lash adjuster 17*b* to open the exhaust valve 5*e*, which then allows the exhaust gas to be discharged from the combustion chamber 2*a* into the exhaust port 4*e*.

During the aforesaid operation of the engine E, the oil pump 30 is operated by the crankshaft 23 to deliver oil under pressure from the oil outlet 30*a* of the oil pump 30 into the first supply passage 31*a*, from which the oil is fed via the second supply passage 31*b* into the first distribution passage 32*a*. The oil under pressure is then supplied as working oil to the second hydraulic lash adjuster 17*b*, and also delivered from the first distribution passage 32*a* via the joint passage 33 and the oil check passage system 38 into the second distribution passage 32*b*, from which the oil is supplied as working oil to the first hydraulic lash adjuster 17*a*.

When the oil pressure in the joint passage 33 rises beyond a predetermined pressure level, the relief valve 37 is opened to allow a portion of the oil to flow from the joint passage 33 into the relief passage 36. Conversely, when the oil pressure in the joint passage 33 drops below the predetermined pressure level, the relief valve 37 is closed to prevent the oil flow from the joint passage 33 through the relief passage 36. With the oil pressure in the joint passage 33 being thus controlled at a proper level, the oil pressure in the first and second distribution passages 32*a*, 32*b* connected to the opposite ends, respectively, of the joint passage 33 is also properly controlled. Therefore, the oil chambers 43 of the respective first and second hydraulic lash adjuster 17*a*, 17*b* are supplied with oil which is maintained under a proper pressure at all times.

The oil flowing through the second supply passage 31*b*, the joint passage 33, and the second distribution passage 32*b* is partly fed into the first, second, and third air vent passages 35*a*, 35*b*, 35*c* while being restricted by the orifices J3, J4, J5, respectively. The oil supplied into the second and third air vent passages 35*b*, 35*c* is delivered therefrom into the lubricating oil passage 34, from which the oil is ejected as lubricating oil via the oil outlet holes 29 downwardly against the cams 12*i*, 12*e* of the camshaft 12 to lubricate the contacting surfaces of the cams 12*i*, 12*e* and the cam followers 15*a*, 15*b*. The journals of the camshaft 12 which are rotatably supported by the bearing surfaces 14*d*, 2*e* are supplied with lubricating oil from the first air vent passage 35*a* and the relief passage 36.

Any oil leakage from the hydraulic tappets 17 and oil that has lubricated the camshaft 12 flows from the chamber 8 via a passage (not shown) into an oil pan (not shown) at the bottom of the engine E. The oil collected in the oil pan is supplied to the oil pump 30 for oil recirculation.

When the operation of the engine E is stopped, the oil pump 30 is also stopped. The oil in the first supply passage 31*a* flows back into the oil pump 30 via the orifice J1. Since the second supply passage 31*b* is inclined obliquely downwardly away from the first supply passage 31*a*, the oil in the second supply passage 31*b* and hence the first and second distribution passages 32*a* and 32*b* is prevented from flowing back through the first supply passage 31*a* into the oil pump 30. As the oil flows downwardly through the first supply passage 31*a*, air in the chamber 8 is drawn through the lubricating oil passage 34 and the first air vent passage 35*a* into the second supply passage 31*b*, thus, preventing the oil from being syphoned from the second supply passage 31*b* into the first supply passage 31*a*. Air in the chamber 8 is also drawn through the second and third air vent passages 35*b*, 35*c* into the second distribution passage 32*b*. Therefore, the oil in the first and second distribution passages 32*a*, 32*b* is reliably prevented from flowing back toward the oil pump 30 through the first and second supply passages 31*a*, 31*b*. The oil check passage system 38 is also effective in checking oil flow from the second distribution passage 32*b* into the joint passage 33.

Since the oil remains in the first and second distribution passages 32*a*, 32*b* after the engine E has stopped its operation, as described above, the first and second hydraulic lash adjusters 17*a*, 17*b* will immediately be supplied with oil directly from the first and second distribution passages 32*a*, 32*b*, prior to oil supply from the oil pump 30, when the engine E is restarted. Consequently, the hydraulic lash adjusters 17*a*, 17*b* can be operated quickly without any significant time delay.

As shown in FIG. 9, the relief valve 37 can easily be serviced simply by removing the plug 58 from the exposed surface 54 of the cylinder head 2 and also removing the spring 57 and the valve body 56 from the valve housing recess 55.

Although a certain preferred embodiment has been shown and described, it should be understood that many changes and modifications may be made therein without departing from the scope of the appended claims.

We claim:

1. A system for supplying oil to a camshaft and hydraulic lash adjusters of a valve operating mechanism in an internal combustion engine having an engine body, comprising:

a supply passage in said engine body for supplying oil under pressure;

a distribution passage in said engine body connected to said supply passage for distributing oil from said supply passage as working oil to the hydraulic lash adjusters;

a lubricating oil passage connected said distribution passage for supplying oil from said distribution passage as lubricating oil to lubricate journals and cams of said camshaft; and a relief passage communicating between said distribution passage and one of said journals and having a relief valve openable when the pressure of oil in said distribution passage rises beyond a predetermined level.

2. A system according to claim 1, further including a cylinder head of said internal combustion engine, said relief passage being defined in said cylinder head, said relief valve being detachably mounted in said cylinder head.

3. A system according to claim 1, further including an oil check passage system connected to said distribution passage for preventing oil from flowing from said distribution passage back to said supply passage.

4. A system according to claim 3, wherein said lubricating oil passage has a plurality of oil outlet holes opening toward said cams of said camshaft, further including an air vent passage interconnected between said oil check passage system and said lubricating oil passage.

5. A system according to claim 4, wherein said air vent passage has an orifice.

6. A system according to claim 1, wherein said lubricating oil passage has a plurality of oil outlet holes opening toward said cams of said camshaft, further including at least one air vent passage interconnected between said distribution passage and said lubricating oil passage.

7. A system according to claim 6, wherein said air vent passage has an orifice.

8. A system according to claim 1, wherein said distribution passage includes a pair of substantially parallel first and second distribution passages connected to respective groups of said hydraulic lash adjusters, said first distribution passage being connected to said supply passage, further including a joint passage interconnected between said first and second distribution passages remotely from said supply passage.

9. A system according to claim 8, further including a relief passage communicating between said joint passage and one of said journals and having a relief valve openable when the pressure of oil in said distribution passage rises beyond a predetermined level.

10. A system according to claim 1, wherein said lubricating oil passage has a plurality of oil outlet holes opening toward said cams of said camshaft, further including first, second, and third air vent passages, said first air vent passage communicating between said supply passage and one of said journals, said second and third air vent passages being interconnected between said distribution passage and said lubricating oil passage.

11. A system according to claim 10, wherein each of said first, second and third air vent passages has an orifice.

12. A system according to claim 1, further including an oil pump, said supply passage comprising first and second supply passages, said first supply passage being connected to said oil pump, said second supply passage being interconnected between said first supply passage and said distribution passage and extending obliquely downwardly away from said first supply passage.

13. A system according to claim 12, further including an air vent passage communicating between said second supply passage and one of said journals of said camshaft.

* * * * *